US008733052B2

(12) United States Patent
Froehlich

(10) Patent No.: US 8,733,052 B2
(45) Date of Patent: May 27, 2014

(54) THERMALLY INSULATING CONSTRUCTION COMPONENT

(71) Applicant: Halfen GmbH, Langenfeld (DE)

(72) Inventor: Klaus Froehlich, Pforzheim (DE)

(73) Assignee: Halfen GmbH, Langenfeld (DE)

( * ) Notice: Subject to any disclaimer, the term of this patent is extended or adjusted under 35 U.S.C. 154(b) by 0 days.

(21) Appl. No.: 13/861,654

(22) Filed: Apr. 12, 2013

(65) Prior Publication Data

US 2013/0276393 A1 Oct. 24, 2013

(30) Foreign Application Priority Data

Apr. 20, 2012 (EP) ..... 12002768

(51) Int. Cl.
*E04B 1/74* (2006.01)
*E04B 1/00* (2006.01)

(52) U.S. Cl.
USPC ..... 52/404.4; 52/404.2; 52/407.3

(58) Field of Classification Search
USPC ..... 52/583.1, 406.3, 404.3, 417–418, 52/425–426, 428, 259, 269, 282.3, 287.1, 52/285.2, 405.3, 582.1, 404.1–404.5, 52/407.1–407.5, 406.1–406.2, 431–433; 312/400, 406, 406.1–406.2
See application file for complete search history.

(56) References Cited

U.S. PATENT DOCUMENTS 3,252,258 A * 5/1966 Blickman et al. ..... 52/582.1
3,982,367 A * 9/1976 Jonsson et al. ..... 52/309.5
4,747,513 A * 5/1988 Betille et al. ..... 220/560.12
4,901,676 A * 2/1990 Nelson ..... 122/19.2
4,959,940 A * 10/1990 Witschi ..... 52/583.1
5,501,359 A * 3/1996 Chauvin et al. ..... 220/592.26
5,628,158 A * 5/1997 Porter ..... 52/309.9
5,799,457 A * 9/1998 Schumacher et al. ..... 52/405.3
5,809,717 A * 9/1998 Scarborough et al. ..... 52/281
6,041,562 A * 3/2000 Martella et al. ..... 52/236.7
7,661,231 B2 * 2/2010 Dalton ..... 52/236.8
2008/0010913 A1 1/2008 Fritschi et al.

FOREIGN PATENT DOCUMENTS

CH 685252 A5 5/1995
DE 197 22 028 A1 12/1998
DE 197 22 051 A1 12/1998
EP 1 564 336 A1 8/2005
EP 1 892 344 A1 2/2008

OTHER PUBLICATIONS

European Search Report dated Aug. 8, 2012 of European application EP 12002768.5.

* cited by examiner

*Primary Examiner* — Jeanette E. Chapman
(74) *Attorney, Agent, or Firm* — Walter Ottesen P.A.

(57) ABSTRACT

A thermally insulating construction component for arranging between two load-bearing parts of a building includes an elongate insulating body and also reinforcing bars extending therethrough transversely with respect, to its longitudinal direction. Bearings project from side walls of the insulating body and absorb thrust and shear forces. The insulating body includes an upper and a lower parallelepipedal dimensionally stable box member filled with insulating material. The insulating body further includes a further dimensionality stable box member which is filled with an insulating material and which is arranged as a middle box member between the upper-box member and the lower box member. The middle box member is fixedly connected to the upper box member and the lower box member.

12 Claims, 4 Drawing Sheets

THERMALLY INSULATING CONSTRUCTION COMPONENT

CROSS REFERENCE TO RELATED APPLICATION

This application claims priority of European patent application no, 12002768.5, filed Apr. 20, 2012, the entire content of which is incorporated herein by reference.

FIELD OF THE INVENTION

The invention relates to a thermally insulating construction component for arranging between two load-bearing parts of a building.

BACKGROUND OF THE INVENTION

EP 1 564 336 A1 discloses a thermally insulating construction component which serves for use in separating joints between load-bearing parts of a building, for example between a building floor and a balcony floor slab. This construction component comprises an insulating body consisting of an upper layer and a lower layer, and also reinforcing elements for tensile reinforcement situated in the upper layer and compression and shear bearings arranged in the lower layer.

CH 685 252 A5 discloses a cantilever-slab connection element with integrated tension or compression bars. Here, the tension and compression bars are accommodated in base elements which consist of sandwich-like profile supports made of plastic. The base elements are connected to one another with the interposition of an additional element made of a foamed plastic.

EP 1 892 344 A1 discloses a thermally insulated construction component for use in separating joints between two parts of a building, in particular a building floor and a balcony floor slab, which adjoin one another in a longitudinal direction. The construction component comprises two approximately parallelepipedal insulating bodies situated above one another with tension rods arranged therein which extend transversely to its longitudinal axis, and also compression and shear bearings. The insulating bodies are in each case formed by a box member which is filled with an insulating material, for example rock wool.

SUMMARY OF THE INVENTION

It is an object of the invention to provide a thermally insulating construction component of the type described above which is configured so as to be adapted universally to the particular use conditions in a simple manner.

The configuration of the insulating body from three or more box members makes it possible in a simple manner for the construction component to be assembled in a manner adapted to the particular set conditions, with the individual box members being selected to achieve a predetermined height and for equipping with reinforcing bars and bearings. This modular principle makes it possible in a simple manner to configure a plurality of individual end products from the different box members. In this way, the construction component can be adapted, with respect to the required load-bearing level and height of the insulating body, to the particular requirements.

Mineral wool is particularly suited as an insulating material for at least one further box member. In a further embodiment, it can also be advantageous for two central box members to foe arranged between the upper box member and the lower-box member. It is practical here for the two intermediate or middle box members to be configured in such a way that they have the same height. As an alternative to this, it is also possible to configure the two middle box members with different heights, which offers the advantage of a greater diversity of variants.

Moreover, it is practical for all the plastic box members to be made from the same, plastic material with at least approximately identical wall thickness. As a result, the load-bearing capacity of the individual box members is particularly high.

Accordingly to a further embodiment of the invention, each box member is designed to be completely closed in itself, with in each case adjacent box members of the insulating body lying flat on one another. This configuration affords the advantage that the cavities filled with insulating material are completely tight and no moisture or even concrete can penetrate when pouring the parts of the building. In addition, the large-area contact is particularly suitable for connecting by means of an adhesive. In addition, it is considered to be advantageous that the box members have at their sides which are directed in each case toward one another longitudinal edges formed in such a way that they engage form locked and force locked in one another during the assembly of the box members. As a result, it is possible to close also those box members which are open at a side directed toward, the adjacent box member during assembly of the box members and to seal them with respect to the outside. To connect the box members to one another, clips or latching devices can be arranged.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
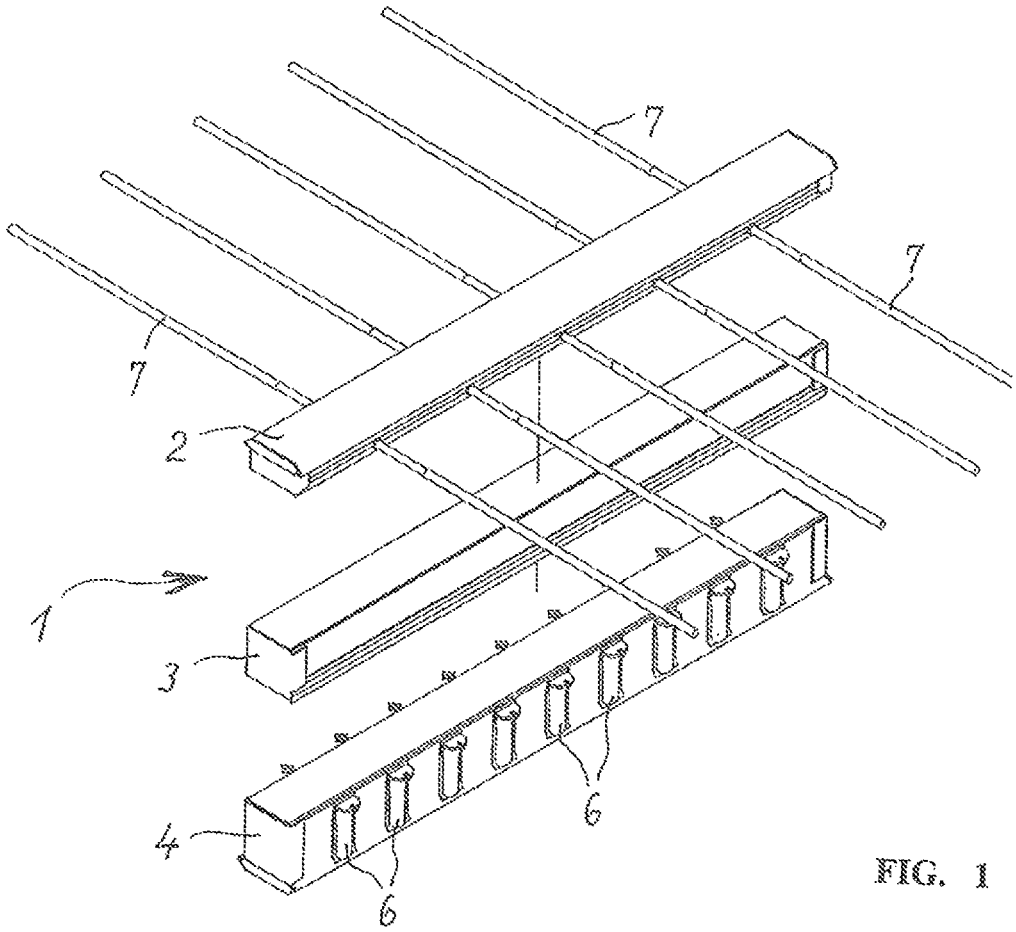
FIG. 1 shows a thermally insulating construction component including an insulating body and reinforcing elements in an exploded view.

FIG. 1 depicts a thermally insulating construction component 1 which includes three elongate box members (2, 3, 4) arranged above one another and also reinforcing bars 7 for the tensile reinforcement and bearings 6 for absorbing compression and shear forces. The box members (2, 3, 4) together form an insulating body 5 (cf. FIG. 4). The reinforcing bars 7 extend orthogonally to the longitudinal axis of the uppermost box 2 and through the latter. The bearings 6 are arranged in the lowermost box member 4 such that they project with, their narrow sides from side walls of this box member 4 so as to be supported on the corresponding adjoining part of the building. Instead of the compression and shear bearings shown in the exemplary embodiment, the box member 4 can also be equipped with compression bearings made of metal, concrete or mortar and also transverse-force bars. The box members (2, 3, 4) are preferably made of a dimensionally stable plastic and are filled with an insulating material, in particular mineral wool.

It can be advantageous for the wail thickness of the plastic, material of all the box members to be at least approximately identical. The box members (2, 3, 4) are provided at their respective mutually adjacent sides with longitudinal edges which engage in one another in a form locked and force locked manner. The longitudinal edges can also serve simultaneously as a latching means. It is also possible for the box members (2, 3, 4) to be connected by means of an adhesive. The box members (2, 3, 4) are connected to one another such that, when pouring the concrete, the latter cannot penetrate the box members. A suitable material for the box members (2, 3, 4) is preferably PVC since this material is very stable and resistant to ageing.

Figure 2:
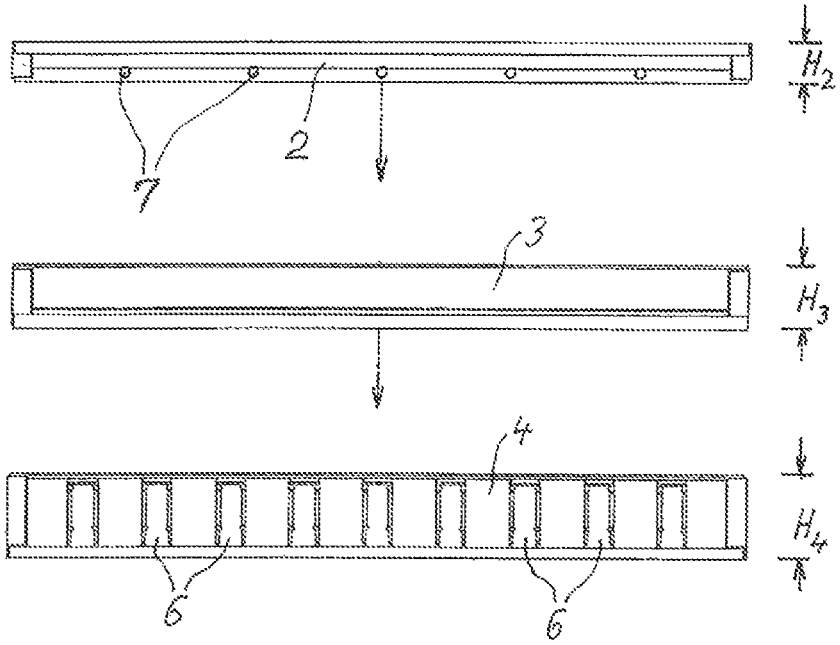
FIG. 2 shows a view of the longitudinal side of the individual parts forming the construction component as per FIG. 1 before the assembly of the individual parts.

FIG. 2 shows a view of the longitudinal side of the box members (2, 3, 4) which form, the insulating body 5 (cf. FIG. 4) for the construction component 1. The reinforcing bars 7 are situated in the upper box member 2 and the bearings 6 are situated in the lower box member 4. The box members (2, 3, 4) are still represented individually in FIG. 2, that is, prior to assembly. The box member 2 has a height $H_2$, the box member 3 has a height $H_3$ and the box member 4 has a height $H_4$. The length and width of the box members (2, 3, 4) is identical, but these box members can be differently dimensioned in terms of their height ($H_2$, $H_3$, $H_4$), as can be seen from FIG. 2. Different configurations can also be available with respect to the number and thickness of the bearings 6 in the box member 4 and reinforcing bars 7 in the box member 2. It is thus possible to generate construction components 1 which are adapted to the particular conditions such as overall height, forces to be absorbed or the like. All that is required for this purpose is to select and assemble the corresponding suitable box members 2, 3 and 4.

Figure 3:
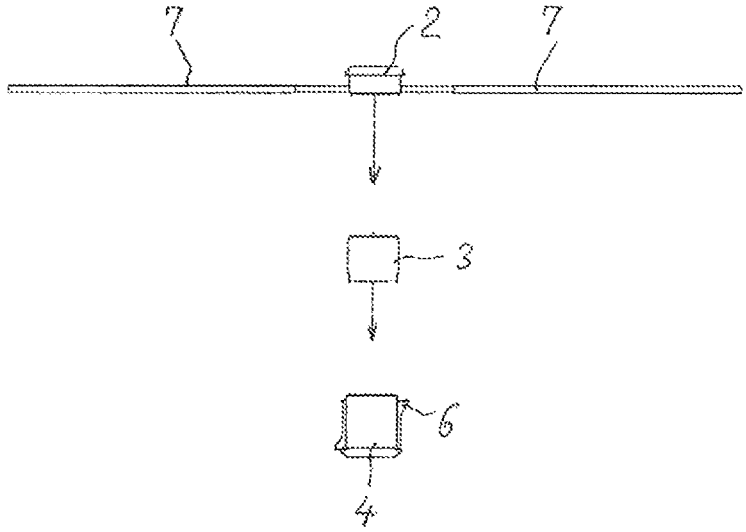
FIG. 3 shows a view of the end side of the arrangement as per FIG. 2.
Figure 4:
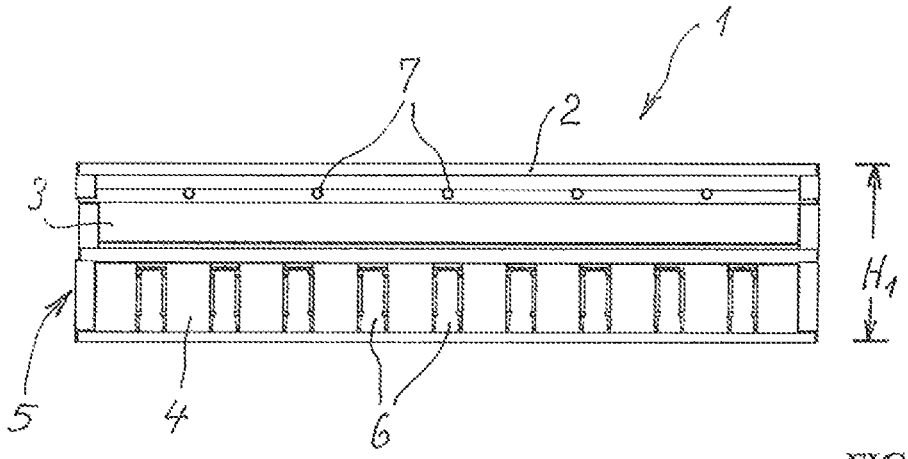
FIG. 4 shows the arrangement of FIG. 2 in the assembled state.
Figure 5:
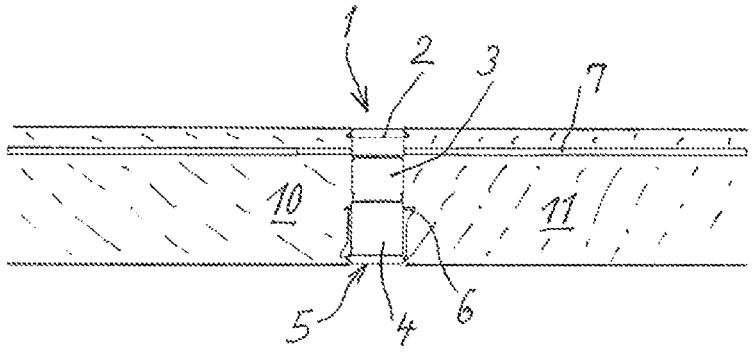
FIG. 5 shows the construction component in a state in which it is installed between parts of a building.

FIG. 3 shows the end view of the arrangement as per FIG. 2 with the three box members (2, 3, 4) which are joined together in order to form the insulating body 5 shown in FIG. 4. The insulating body 5 with the reinforcing bars 7 and bearings 6 arranged in the box members 2 and 4 forms the construction component 1 for thermal insulation. The insulating body 5 composed of the box members (2, 3, 4) has the overall height $H_1$ of the construction component 1, which results from the individual heights $H_2$, $H_3$ and $H_4$ indicated in FIG. 2. FIG. 5 shows a view of the construction component 1 as per FIG. 4 transversely with respect to the longitudinal direction, where the reference characters of FIGS. 1 to 4 correspond, for identical parts. It can be seen from FIG. 5 that the construction component 1 is arranged between a building floor 10 and a balcony slab 11.

Figure 6:
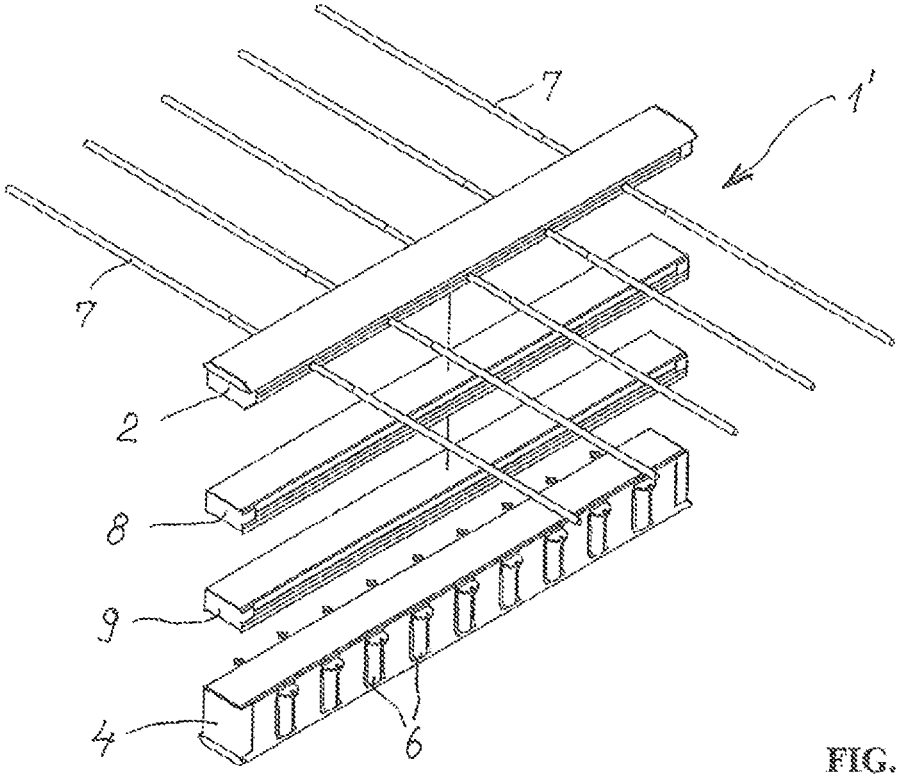
FIG. 6 shows an alternative embodiment of the construction component in FIG. 1.
Figure 9:
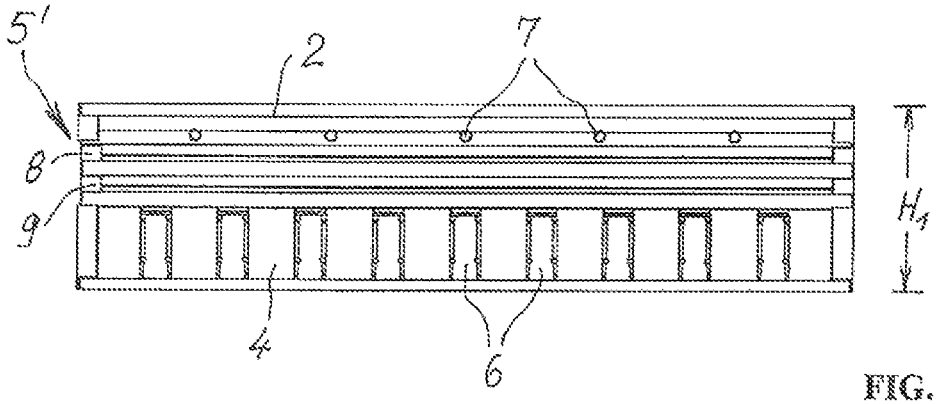
FIG. 9 shows the arrangement of FIG. 7 in the assembled state.

FIG. 6 depicts a thermally insulating construction component 1' in which two central box members 8 and 9 are provided between the upper box member 2 and the lower box member 4. In this embodiment, too, all the box members together form an insulating body 5', as is represented completely assembled in FIGS. 9 and 10. In FIG. 6, the reinforcing bars 7 are provided in the upper box member 2 and the bearings 6 are arranged in the lower box member 4, this configuration corresponding to that shown it FIGS. 1 to 5. The box members 2, 4, 8 and 9 are preferably made of a dimensionally stable plastic and are filled with an insulating material. The longitudinal edges of the box members (2, 4, 8, 9) are configured such that the box members can be connected in a suitable manner, with the insulating body 5' being completely closed and the penetration of concrete being prevented.

Figure 7:
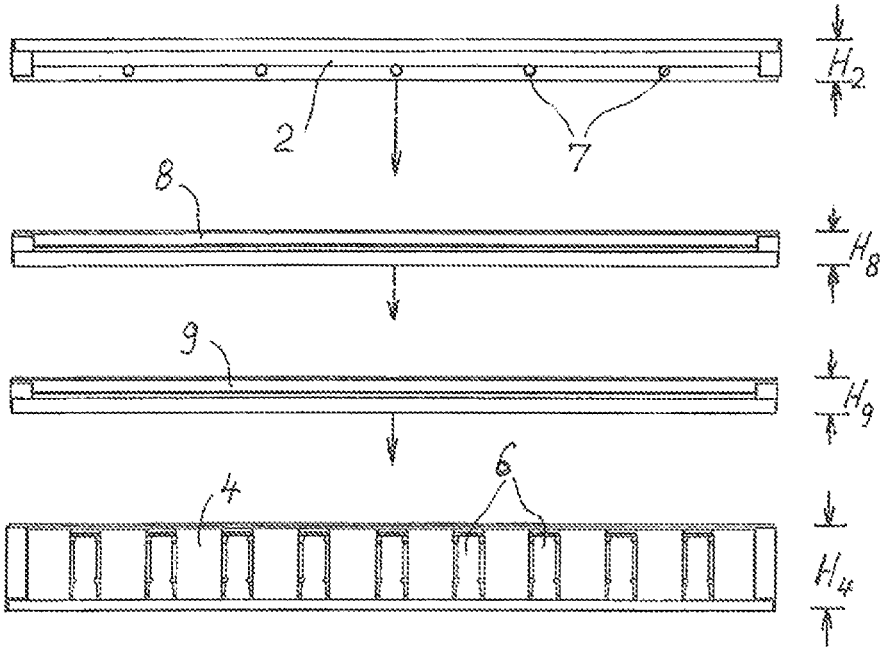
FIG. 7 shows the longitudinal side of the construction component of FIG. 6 before the assembly of the individual parts.

FIG. 7 shows a view of the longitudinal side of the box members (2, 4, 8, 9) which form the insulating body 5' (FIGS. 9 and 10) for the construction component 1'. The box members (2, 4) with reinforcing bars 7 and bearings 6 are identical to those in FIG. 2, as are therefore also their heights $H_2$ and $H_4$. The box member 8 has a height $H_8$ and the box member 9 has a height $H_9$, which are identical in the example shown, although these can also be different.

Figure 8:
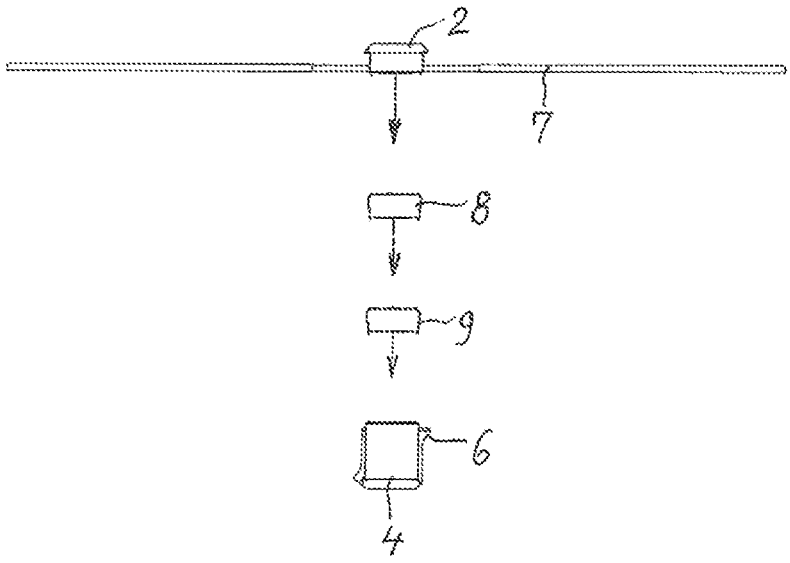
FIG. 8 shows the end side of the arrangement of FIG. 7.
Figure 10:
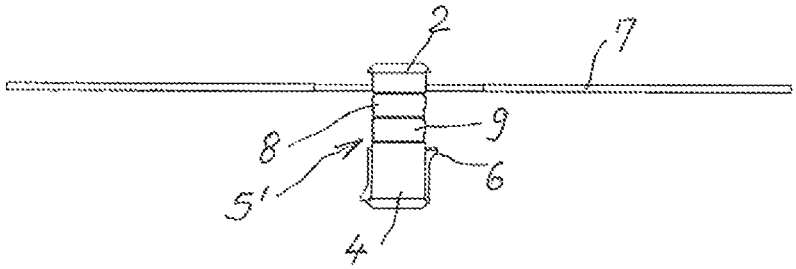
FIG. 10 shows a view of the end side of the arrangement of FIG. 9.

FIG. 8 shows the end view of the arrangement as per FIG. 7, wherein, the box members 2, 4, 8 and 9 have not yet been joined together. The box members 2, 8, 9 and 4 oriented above one another as per FIGS. 7 and 8 are fixedly connected to one another such that they produce the insulating body 5' in FIG. 9, which, together with the reinforcing bars 7 and the bearings 6, forms the thermally insulating construction component 1'. The completely assembled construction component 1' has the overall height $H_1$ which results from the addition of the heights $H_2$, $H_8$, $H_9$ and $H_4$ of the box members (2, 8, 9, 4). FIG. 10 shows an end view of the construction component 1' as per FIG. 9, where the reference characters correspond for identical parts.

The modular principle according to the invention makes it possible in a simple manner to produce many variants of different overall heights $H_1$. Assuming that the heights $H_2$ and $H_4$ of the box members 2 and 4 are constant and have for example together a height of 16 cm, it is possible with, central box members (3, 8, 9) having a height ($H_3$, $H_8$, $H_9$) of 2 cm and 3 cm to obtain different combinations, for example 16 cm+2 cm=18 cm 16 cm+3 cm=19 cm 16 cm+2 cm+2 cm=20 cm 16 cm+3 cm+2 cm=21 cm 16 cm+3 cm+3 cm=22 cm or greater overall heights $H_1$ can be achieved by adding further middle box members.

It is understood that the foregoing description is that of the preferred embodiments of the invention and that various changes and modifications may be made thereto without departing from the spirit and scope of the invention as defined in the appended claims.

What is claimed is:

1. A thermally insulating structural component for arrangement between two load bearing construction parts, the thermally insulating structural component comprising:

an elongated insulating body having side walls defining a longitudinal direction;

a plurality of reinforcement bars extending through said elongated insulating body transverse to said longitudinal direction;

a plurality of bearings arranged so as to protrude from said side. Walls of said insulating body and configured to absorb thrust and shear forces;

said insulating body having a dimensionally stable, square or rectangular shaped upper box member and a dimensionally stable, square or rectangular shaped lower box member, said upper and said lower box members being filled, with insulating material;

said insulating body further having at least one additional dimensionally stable intermediate box member filled with an insulating material and said intermediate box member being arranged between said upper box member and said lower box member;

and, said intermediate box member being fixedly connected to said upper box member and said lower box member.

2. The structural component of claim 1, wherein said insulating material of said intermediate box member is mineral wool.

3. The structural component of claim 1, wherein said intermediate box member is a first intermediate box member and said insulating body further has a second intermediate box member arranged between said upper box member and said lower box member.

4. The structural component of claim 3, wherein said first intermediate box member has a height ($H_8$) and said second intermediate box member has a height ($H_9$) and said height ($H_8$) is equal to said height ($H_9$).

5. A thermally insulating structural component for arrangement between two load bearing construction parts, the thermally insulating structural component comprising:

an elongated insulating body having side walls defining a longitudinal direction;

a plurality of reinforcement bars extending through said elongated insulating body transverse to said longitudinal direction;

a plurality of bearings arranged so as to protrude from said side walls of said insulating body and configured to absorb thrust and shear forces;

said insulating body having a dimensionally stable, square or rectangular shaped upper box member ends dimensionally stable, square or rectangular shaped lower box member, said upper and said lower box members being filled with insulating material;

said insulating body further having at least one additional dimensionally stable intermediate box member filled with an insulating material and said intermediate box member being arranged between said upper box member and said lower box member;

said intermediate box member being fixedly connected to said upper box member and said lower box member;

said intermediate box member being a first intermediate box member and said insulating body further having a second intermediate box member arranged between said upper box member and said lower box member; and, said first intermediate box member having a height ($H_8$) and said second intermediate box member having a height ($H_9$) and said height ($H_8$) being unequal to said height ($H_9$).

6. The structural component of claim 5, wherein said height ($H_8$) is 2 cm and said height ($H_9$) is 3 cm.

7. The structural component of claim 1, wherein said upper box member, said lower box member and said intermediate box member are made from the same plastics material and each has an approximately identical wall thickness.

8. The structural component, of claim 1, wherein said upper box member, said lower box member, and said intermediate box member are each configured to be completely closed so that each two mutually adjacent ones of said box members are in surface-to-surface contact with each other.

9. A thermally insulating structural component for arrangement between two load bearing construction parts, the thermally insulating structural component comprising:

an elongated insulating body having side walls defining a longitudinal direction;

a plurality of reinforcement bars extending through said elongated insulating body transverse to said longitudinal direction;

a plurality of bearings arranged so as to protrude from said side walls of said insulating body and configured to absorb thrust and shear forces;

said insulating body having a dimensionally stable, square or rectangular shaped upper box member and a dimensionally stable, square or rectangular shaped lower box member, said upper and said lower box members being filled with insulating material;

said insulating body further having at least one additional dimensionally stable intermediate box member filled with an insulating material and said intermediate box member being arranged between said upper box member and said lower box member;

said intermediate box member being fixedly connected to said upper box member and said lower box member;

said upper box member, said lower box member, and said intermediate box member each having a side facing a side of another one of said box members, each two of said sides being in mutual contact engagement with each other; and each one of said mutually contact engaging sides having a longitudinal edge formed thereon so as to cause the respective longitudinal edges of each two mutually contact engaging sides to interdigitally engage to conjointly define a form locking and force looking connection when said boxes are joined to each other.

10. The structural component of claim 1, wherein said box members are interconnected via an adhesive.

11. A thermally insulating structural component for arrangement between two load bearing construction parts, the thermally insulating structural component comprising:

an elongated insulating body having side walls defining a longitudinal direction;

a plurality of reinforcement bars extending through said elongated insulating body transverse to said longitudinal direction;

a plurality of bearings arranged so as to protrude from said side walls of said insulating body and configured to absorb thrust and shear force;

said insulating body having a dimensionally stable square or rectangular shaped upper box member and a dimensionally stable, square or rectangular shaped lower box member, said upper and said lower box members being filled with insulating material;

said insulating body further having at least one additional dimensionally stable intermediate box member filled with an insulating material and said intermediate box member being arranged between said upper box member and said lower box member;

said intermediate box member being fixedly connected to said upper box member and said lower box member;

at least one of clips and a snap-in locking device arranged on said box members and configured to interconnect said box members.

12. The structural component of claim 1, wherein the two load bearing construction parts are a building slab and a balcony base plate.

* * * * *

UNITED STATES PATENT AND TRADEMARK OFFICE

CERTIFICATE OF CORRECTION

PATENT NO. : 8,733,052 B2
APPLICATION NO. : 13/861654
DATED : May 27, 2014
INVENTOR(S) : Klaus Froehlich It is certified that error appears in the above-identified patent and that said Letters Patent is hereby corrected as shown below:

On Title Page:
Under (57) Abstract, fourth line: delete "respect," and insert -- respect -- therefor.
Under (57) Abstract, ninth line: delete "dimensionality" and insert -- dimensionally -- therefor.
Under (57) Abstract, twelfth line: delete "upper-box" and insert -- upper box -- therefor.

In the Specification:
In Column 2:
Line 1: delete "foe" and insert -- be -- therefor.
Line 2: delete "lower-box" and insert -- lower box -- therefor.

In Column 3:
Line 13: delete "wail" and insert -- wall -- therefor.

In the Claims:
In Column 4:
Line 63: delete "side. Walls" and insert -- side walls -- therefor.

In Column 5:
Line 2: delete "filled," and insert -- filled -- therefor.
Line 36: delete "ends" and insert -- and a -- therefor.

In Column 6:
Line 27: delete "and" and insert -- and, -- therefor.
Line 47: delete "stable" and insert -- stable, -- therefor.

Signed and Sealed this
Twelfth Day of August, 2014

Michelle K. Lee

Michelle K. Lee
*Deputy Director of the United States Patent and Trademark Office*